US005960896A

United States Patent [19]

Barr et al.

[11] Patent Number: 5,960,896

[45] Date of Patent: Oct. 5, 1999

[54] ROTARY DRILL BITS EMPLOYING OPTIMAL CUTTER PLACEMENT BASED ON CHAMFER GEOMETRY

[75] Inventors: David H. Barr, The Woodlands; Danny E. Scott, Montgomery, both of Tex.; Craig H. Cooley, South Ogden, Utah

[73] Assignee: Baker Hughes Incorporated, Houston, Tex.

[21] Appl. No.: 08/925,883

[22] Filed: Sep. 8, 1997

[51] Int. Cl.[6] ..... E21B 10/46

[52] U.S. Cl. ..... 175/431; 76/108.2

[58] Field of Search ..... 175/398, 415, 175/420.2, 428, 431, 434; 76/108.2, 108.4

[56] References Cited

U.S. PATENT DOCUMENTS

| | | | |
|---|---|---|---|
| Re. 32,036 | 11/1985 | Dennis . | |
| 4,342,368 | 8/1982 | Denman . | |
| 4,607,711 | 8/1986 | Zijsling . | |
| 4,792,001 | 12/1988 | Zijsling . | |
| 4,913,247 | 4/1990 | Jones | 175/434 |
| 4,926,950 | 5/1990 | Zijsling . | |
| 5,016,718 | 5/1991 | Tandberg . | |
| 5,033,560 | 7/1991 | Sawyer et al. | 175/431 |
| 5,222,566 | 6/1993 | Taylor et al. | 175/431 |
| 5,314,033 | 5/1994 | Tibbitts | 175/434 |
| 5,379,853 | 1/1995 | Lockwood et al. . | |
| 5,437,343 | 8/1995 | Cooley et al. . | |
| 5,582,261 | 12/1996 | Keith et al. | 175/434 |
| 5,605,198 | 2/1997 | Tibbitts et al. . | |
| 5,706,906 | 1/1998 | Jurewicz et al. . | |

*Primary Examiner*—William Neuder
*Attorney, Agent, or Firm*—Trask, Britt & Rossa

[57] ABSTRACT

A rotary drag bit equipped with a plurality of cutters, each including a superabrasive cutting face, wherein cutters carried by the bit have at least two differing chamfer geometries adjacent their cutting edges. Chamfer geometries are selected according to location on the face of the bit responsive to the relative ease or difficulty of cutting formation rock and the severity of dynamic loading at that location. The bit face may be characterized as comprising at least two areas or regions bearing cutters having differing chamfer geometries to maximize rate of penetration of the bit while preserving cutter integrity when subjected to differing stresses and encountering zones of the formation exhibiting different strengths. Characteristics, such as hardness, abrasiveness and homogeneity, of the target formation or formations to be drilled by the bit may be considered when selecting appropriate chamfer geometries for the cutters allocated to cut each formation zone opposite the bit face.

16 Claims, 2 Drawing Sheets

ROTARY DRILL BITS EMPLOYING OPTIMAL CUTTER PLACEMENT BASED ON CHAMFER GEOMETRY

BACKGROUND OF THE INVENTION

1. Field of the Invention

The present invention relates generally to rotary bits for drilling subterranean formations. More specifically, the invention relates to fixed cutter, or so-called "drag," bits employing superabrasive cutters exhibiting varying cutting edge chamfer geometries at different locations or zones on the face of the bit, the variations being tailored to enhance durability of individual cutters while not curtailing rate of penetration (ROP) of the bit.

2. State of the Art

For some time, it has been known that forming a noticeable, annular chamfer on the cutting edge of the diamond table of a polycrystalline diamond compact (PDC) cutter has enhanced durability of the diamond table, reducing its tendency to spall and fracture during the initial stages of a drilling operation before a wear flat has formed on the side of the diamond table and supporting substrate contacting the formation being drilled. It is believed that such a feature offers similar benefits to superabrasive cutters other than PDCs, such as thermally stable PDCs and cubic boron nitride compacts.

U.S. Pat. No. Re 32,036 to Dennis discloses such a chamfered cutting edge, disc-shaped PDC cutter comprising a polycrystalline diamond table formed under high pressure and high temperature conditions onto a supporting substrate of tungsten carbide. For conventional PDC cutters, a conventional chamfer size (radial width) and angle would be 0.010 inch (looking at and perpendicular to the cutting face of the diamond table) oriented at a 45° angle with respect to the longitudinal cutter axis, thus providing a larger radial width as measured on the chamfer surface itself. Multi-chamfered PDC cutters are also known in the art, as taught by Cooley et al. in U.S. Pat. No. 5,437,343, assigned to the assignee of the present invention. Rounded, rather than chamfered, cutting edges are also known, as disclosed in U.S. Pat. No. 5,016,718 to Tandberg.

For some period of time, the diamond tables of PDC cutters were limited in depth or thickness to about 0.030 inch or less, due to the difficulty in fabricating thicker tables of adequate quality. However, recent process improvements have provided much thicker diamond tables, in excess of 0.070 inch, up to and including 0.130 inch. Pending U.S. patent application Ser. No. 08/602,076, now U.S. Pat. No. 5,706,906, filed Feb. 15, 1996 and assigned to the assignee of the present invention, discloses and claims several configurations of a PDC cutter employing a relatively thick diamond table. Such cutters include a cutting face bearing a large chamfer or "rake land" thereon adjacent the cutting edge, which rake land may exceed 0.050 inch in width, measured radially and across the surface of the rake land itself. Other cutters exhibiting large chamfers but without diamond tables of such great depth are also known.

Recent laboratory testing as well as field tests have conclusively demonstrated that one significant parameter affecting PDC cutter durability is the cutting edge geometry. Specifically, larger leading chamfers (the first chamfer on a cutter to encounter the formation when the bit is rotated in the normal direction) provide more durable cutters. The robust character of the above-referenced "rake land" cutters corroborates these findings, but has also demonstrated a tendency to undesirably limit ROP.

The art has thus provided the design for a robust cutter structure which has yet to be fully appreciated and employed, due to demonstrated ROP limitations. Further, the art has failed thus far to appreciate any benefit in varying superabrasive, and specifically PDC, cutter chamfer geometry on a bit face so as to maximize both cutter durability and ROP of the bit on which the cutters are mounted.

The inventors herein have discovered that certain locations or zones on a bit face cut the adjacent formation face more readily than others. For example, referring to FIG. 1 of the drawings, schematically depicted is an exemplary PDC rotary drag bit 310 including a bit body 312 with a bit profile 314 extending radially outwardly from a centerline or longitudinal axis 316. In bit 310, cone 318 comprising a first region immediately surrounding the centerline cuts a generally circular, conical cutting zone 42 in the formation 40 which is much more easily cut than annular cutting zone 44, cut by a second region comprising the nose 320, flank 322 and shoulder 324 of the bit profile 314. Higher in situ stresses in the zone 44 rock adjacent nose 320, flank 322 and shoulder 324 of the second region combine with stresses induced from loading by PDC cutters 330 thereon to strengthen the rock. In contrast, the rock of zone 42 cut by center or cone first region PDC cutters 330 is largely stress relieved in comparison to that of zone 44, facilitating the shearing of cuttings therefrom. Use of a single cutter configuration in the various bit regions as in conventional bits is deficient in optimizing ROP, cutter durability, or both. Moreover, using only cutters having conventional small chamfers does not provide sufficient durability for cutters located over all regions of the bit face when drilling many formations.

Further, it is known that dynamic loading differs as to magnitude and direction with respect to cutters at different locations over the bit face, and such magnitudes and directions can be predicted with some reliability for cutter locations for a given bit profile with respect to a given rock formation type. A discussion of cutter loading and the factors affecting same, including rock strength confronting cutters at different locations over a bit face, may be found in U.S. Pat. No. 5,605,198 to Tibbitts et al., assigned to the assignee of the present invention and incorporated herein by reference.

BRIEF SUMMARY OF THE INVENTION

The present invention comprises a rotary drag bit wherein formation rock zones presenting varying difficulties of cutting corresponding to different locations or regions over the bit face have been identified, the dynamic loading on cutters to be disposed in the different locations or regions has been predicted, and an appropriate cutting edge chamfer width or size (hereinafter sometimes "chamfer category") for the PDC or other superabrasive cutters in each region selected. Depending upon the profile of the bit, there may be essentially two zones, as discussed above, three zones, or even more in the case of relatively complex profiles and sophisticated cutter placements. Furthermore, cutters disposed in a boundary region between one cutting zone and another may exhibit chamfers intermediate in size between those of each adjacent zone, or cutters bearing both categories of chamfers may be disposed in the boundary region. Carried to its logical extreme, optimal chamfer size may be selected for each cutter position on a bit, including the gage.

Chamfers may also be selected based upon a target formation type or range of types, and expected drilling conditions. For example, chamfer size may be increased in proportion to rock hardness to a certain point. However, a large chamfer cutter may prove ineffective against extremely hard rock, where a relatively sharp cutter may be preferred, particularly if the rock is of homogeneous character. Further, when drilling in layered or other non-homogeneous, interbedded formations such as rock containing chert where vibration is expected to be a problem, cutters with relatively larger chamfers may be selected. This is, as implied above, in contrast to drilling in homogenous rock, where vibration is not a substantial consideration.

In one exemplary embodiment, a bit designed and fabricated according to the invention carries sharper cutters in the center or cone where cutting the stress-relieved rock is easy and relative depth of cut great, while cutters with larger chamfers are located on the nose and flank and extend to the shoulder where the rock cutting is more difficult, the dynamic loading of the cutters is more severe, and thus greater cutter durability is required.

DETAILED DESCRIPTION OF THE INVENTION

Referring now to FIGS. 1 and 2A through 5, as previously noted it is contemplated by the invention that superabrasive cutters such as PDCs exhibiting different chamfer sizes may be employed over different regions of the bit face.

Figure 1:
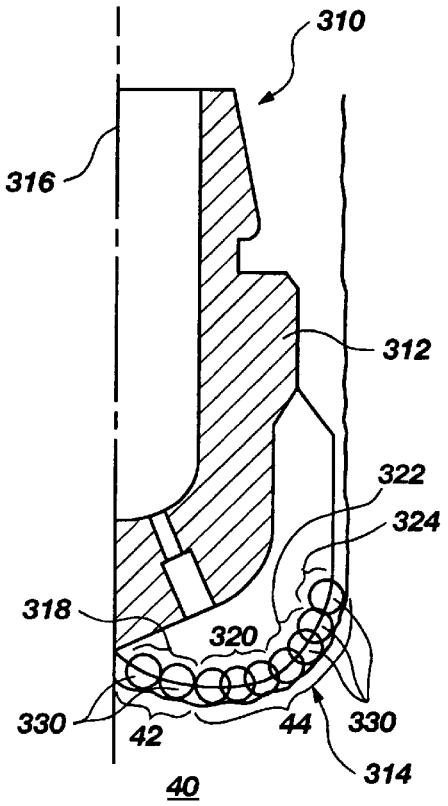
FIG. 1 comprises a side quarter-sectional schematic view of an exemplary rotary drag bit engaged with a subterranean rock formation during a drilling operation.
Figure 2A:
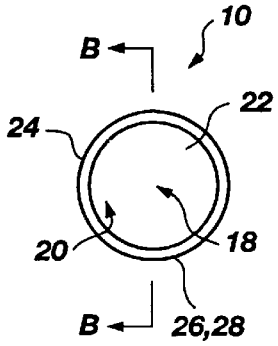
FIG. 2A comprises a frontal view of a small chamfer PDC cutter usable with the present invention and FIG. 2B comprises a side sectional view of the small chamfer PDC cutter of FIG. 2A, taken along section lines B—B.
Figure 2B:
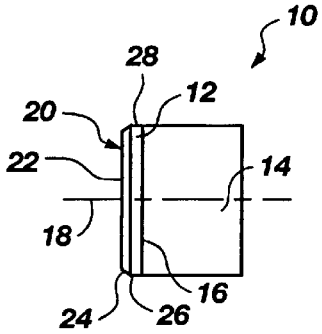

FIGS. 2A and 2B depict an exemplary "small chamfer" cutter 10 comprised of a superabrasive, PDC table 12 supported by a WC carbide substrate 14. The interface 16 between the PDC diamond table 12 and the substrate 14 may be planar or non-planar, according to many varying designs for same as known in the art. Cutter 10 is substantially cylindrical and symmetrical about longitudinal axis 18, although such symmetry is not required and non-symmetrical cutters are known in the art. Cutting face 20 of cutter 10, to be oriented on a bit facing generally in the direction of bit rotation, extends substantially transversely to such direction, and to axis 18. The surface 22 of the central portion of cutting face 20 is planar as shown, although concave, convex, ridged or other substantially, but not exactly, planar surfaces may be employed. A chamfer 24 extends from the periphery of surface 22 to cutting edge 26 at the sidewall 28 of diamond table 12. Chamfer 24 and cutting edge 26 may extend about the entire periphery of table 12, or only along a periphery portion to be located adjacent the formation to be cut. Chamfer 24 may comprise the aforementioned 0.010 inch by 45° angle conventional chamfer, or may lie at some other angle, as referenced with respect to the chamfer 124 of cutter 110 described below. While 0.010 inch chamfer size is referenced as an example (within conventional tolerances), chamfer sizes within a range of 0.001 to about 0.015 inch (measured as previously described) are contemplated as providing a "small" chamfer for the practice of the invention.

Figure 3:
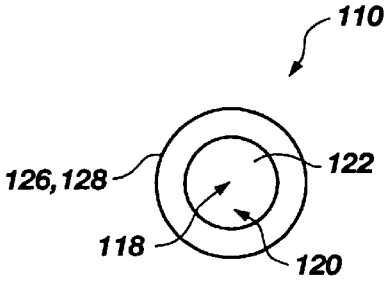
FIG. 3 comprises a frontal view of a large chamfer PDC cutter usable with the present invention.
Figure 4:
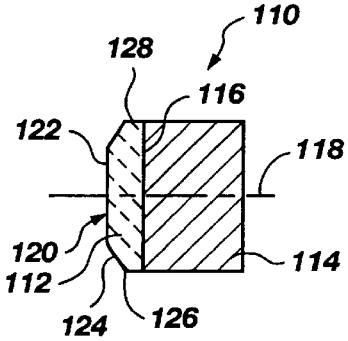
FIG. 4 comprises a side sectional view of a first internal configuration for the large chamfer PDC cutter of FIG. 3.
Figure 5:
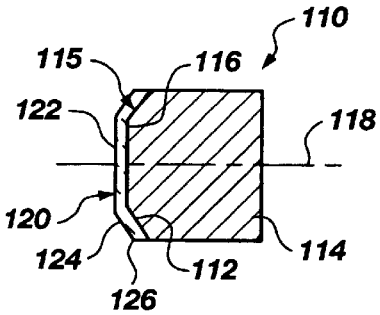
FIG. 5 comprises a side sectional view of a second internal configuration for the large chamfer PDC cutter of FIG. 3.

FIGS. 3 through 5 depict an exemplary "large chamfer" cutter 110 comprised of a superabrasive, PDC table 112 supported by a WC carbide substrate 114. The interface 116 between the PDC diamond table 112 and the substrate 114 may be planar or non-planar, according to many varying designs for same as known in the art (see especially FIGS. 4 and 5). Cutter 110 is substantially cylindrical and symmetrical about longitudinal axis 118, although such symmetry is not required and non-symmetrical cutters are known in the art. Cutting face 120 of cutter 110, to be oriented on a bit facing generally in the direction of bit rotation, extends substantially transversely to such direction, and to axis 118. The surface 122 of the central portion of cutting face 120 is planar as shown, although concave, convex, ridged or other substantially, but not exactly, planar surfaces may be employed. A chamfer 124 extends from the periphery of surface 122 to cutting edge 126 at the sidewall 128 of diamond table 112. Chamfer 124 and cutting edge 126 may extend about the entire periphery of table 112, or only along a periphery portion to be located adjacent the formation to be cut. Chamfer 124 may comprise a surface oriented at 45° to axis 118, of a width, measured looking at and perpendicular to the cutting face 120, of from about 0.015 inch to in excess of 0.050 inch, but generally between about 0.015 and 0.025 inch for most drilling applications. Large "rake land" chamfers as mentioned above and in an about 0.040 to 0.060 inch chamfer width range may be employed selectively in soft, abrasive formations such as unconsolidated sandstones, as required.

Chamfer angles of about 10° to about 80° to axis 118 are believed to have utility, with angles in the range of about 30° to about 60° being preferred. The effective rake angle of a chamfer with respect to the formation may be altered by changing the backrake of the cutter.

FIG. 4 illustrates one internal configuration for cutter 110, wherein table 112 may range from a conventional thickness of from about 0.030 to 0.040 inch to an extreme thickness on the order of 0.070 inch or greater, in accordance with the teachings of the aforementioned '076 application.

FIG. 5 illustrates a second internal configuration for cutter 110, wherein the front face 115 of substrate 114 is frustoconical in configuration, and table 112, of substantially constant depth, conforms to the shape of front face 115 to provide a desired large chamfer width without requiring a large PDC diamond mass such as is disclosed in the '076 application.

It should be understood that the thickness of the superabrasive tables employed in the large chamfer cutters employed with the invention, as well as the configuration of the table-to-substrate interface, may be varied so that a chamfer of adequate size may be provided between the front of the cutting face and the side of the cutter at the cutting edge while staying within the confines of the side of the table. Chamfer angle may also affect the required table thickness and interface configuration for a given chamfer width.

Figure 6:
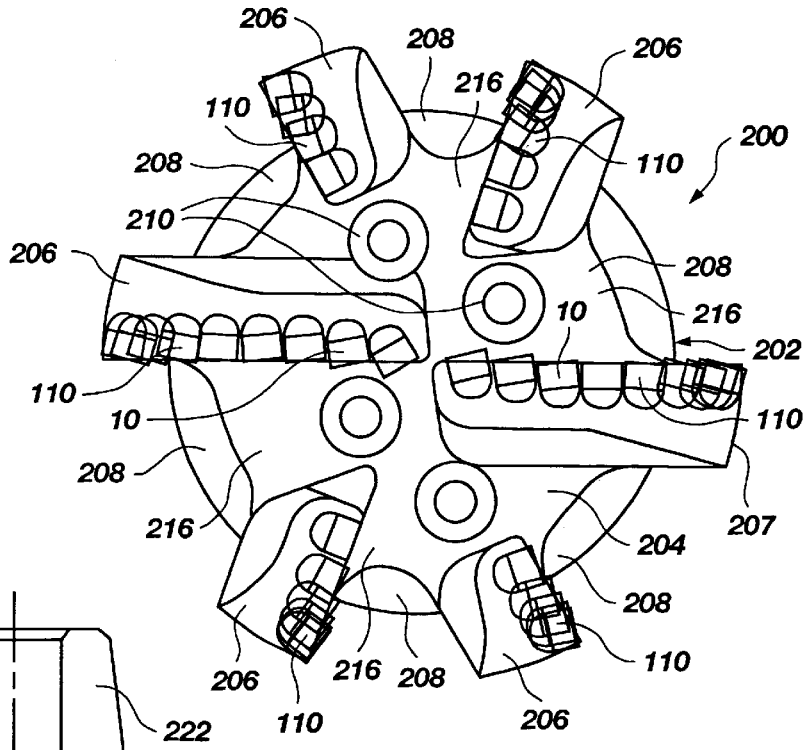
FIG. 6 comprises a bit face view, looking upward from the formation, of an exemplary rotary drag bit according to the invention.
Figure 7:
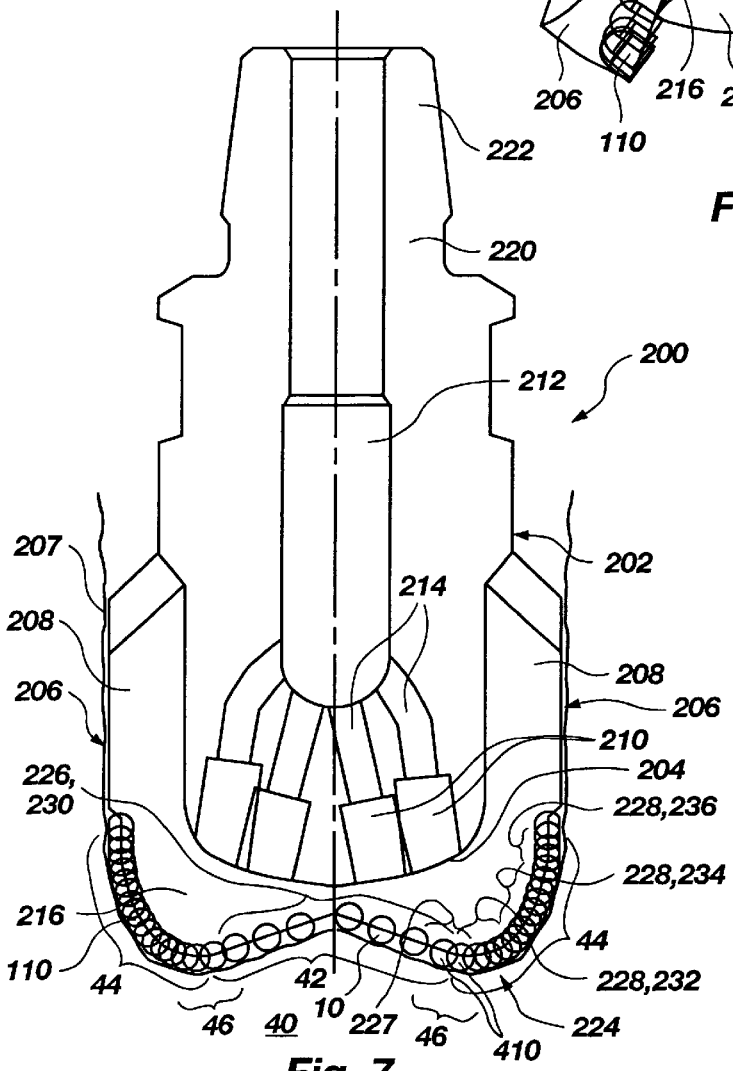
FIG. 7 comprises a side sectional view of the bit of FIG. 6 showing cutter locations on the bit profile and nozzle locations and orientations.

FIGS. 6 and 7 depict a rotary drag bit 200 according to the invention. Bit 200 includes a body 202 having a face 204 and including a plurality (in this instance, six) of generally radially oriented blades 206 extending above the bit face 204 to a gage 207. Junk slots 208 lie between adjacent blades 206. A plurality of nozzles 210 provide drilling fluid from plenum 212 within the bit body 202 and received through passages 214 to the bit face 204, formation cuttings generated during a drilling operation being transported across bit face 204 within fluid courses 216 communicating with respective junk slots 208. Shank 220 includes a threaded pin connection 222 as known in the art, although other connection types may be employed.

The profile 224 of the bit face 204 as defined by blades 206 is illustrated in FIG. 7, wherein bit 200 is shown adjacent a subterranean rock formation 40 and zones 42 and 44 thereof at the bottom of the well bore. First region 226 and second region 228 on profile 224, respectively facing zones 42 and 44, also respectively carry small chamfer cutters 10 and large chamfer cutters 110. First region 226 may be said to comprise the cone 230 of the bit profile 224 as illustrated, whereas second region 228 may be said to comprise the nose 232, flank 234 and extend to shoulder 236 of profile 224. A boundary region, rather than a sharp boundary, may exist between first and second regions 226 and 228. For example, rock zone 46 bridging the edges of rock zones 42 and 44 of formation 46 may comprise an area wherein demands on cutters and the strength of the formation are always in transition due to bit dynamics. Alternatively, the boundary rock zone 46 may initiate the presence of a third region on the bit profile wherein a third size of cutter chamfer is desirable. In any case, the annular area 227 of profile 224 opposing zone 46 may be populated with cutters 410 of both the types employed in region 226 and those of region 228, or cutters with chamfer sizes intermediate those of the cutters in regions 226 and 228 may be employed.

Bit 200, equipped as described with a combination of small chamfer cutters 10 and large chamfer cutters 110, will drill with substantially equivalent ROP to conventional bits equipped only with small chamfer cutters but maintain superior cutter integrity, and far faster than a bit equipped only with large chamfer cutters.

The inventors herein believe that a significant concept of the invention producing the above-described superior performance in combination with maintenance of cutter integrity is optimization of cutter chamfer size for the loading or cutting mechanics experienced by cutters at various positions on the bit body. Therefore, the invention is not limited, nor should it be construed as limited, to use with any given bit profile, cutter type or size, application or target formation. Rather, the invention is applicable to improvement of bit performance and cutter durability in general, the specific manner of effecting such improvements varying with the goals to be achieved.

Finally, redundancy of cutters affects cutter loading, depth of cut (DOC) and ROP. Since the size or width of a cutter chamfer affects the contact area of a cutter with the formation being cut, the inventors herein have recognized that cutter geometry should also be considered when determining cutter placement and redundancy.

While the present invention has been described in light of the illustrated embodiment, those of ordinary skill in the art will understand and appreciate it is not so limited, and many addition, deletions and modifications may be effected to the invention as illustrated without departing from the scope of the invention as hereinafter claimed.

What is claimed is:

1. A rotary drag bit for drilling a subterranean formation, comprising:

a bit body having a longitudinal axis and extending radially outward therefrom to a gage, the bit body further comprising at least a first region and a second region over a face to be oriented toward the subterranean formation during drilling; and a plurality of cutters located on the bit body in the first and second regions, the cutters each comprising a superabrasive cutting face extending in two dimensions substantially transverse to a direction of cutter movement during drilling and including a cutting edge located to engage the subterranean formation, wherein the cutting face of at least one cutter located in the first region exhibits a chamfer adjacent the cutting edge of a substantially different width than a width of a cutting edge-adjacent chamfer of at least one cutter located in the second region.

2. The rotary drag bit of claim 1, wherein the first region comprises an area closer to the longitudinal axis of the bit body than the second region, and the chamfer width of the at least one first region cutter is smaller than the width of the at least one second region cutter.

3. The rotary drag bit of claim 2, wherein the first region lies within a cone over the face of the bit body, and the second region extends at least over a nose and flank on the face of the bit body.

4. The rotary drag bit of claim 3, wherein the second region extends to the gage of the bit body.

5. The rotary drag bit of claim 1, wherein the superabrasive cutting faces are formed on polycrystalline diamond compact tables.

6. The rotary drag bit of claim 5, wherein the polycrystalline diamond compact tables are supported by metallic substrates.

7. The rotary drag bit of claim 6, wherein the polycrystalline diamond compact table of the at least one cutter in the second region is thicker than the polycrystalline diamond compact table of the at least one cutter in the first region.

8. The rotary drag bit of claim 1, wherein the chamfers of at least a majority of the cutters in the second region are larger than the chamfers of at least a majority of the cutters in the first region.

9. The rotary drag bit of claim 1, further including at least one cutter located proximate a boundary between the first and second regions, and having a chamfer intermediate in width between the chamfer of the at least one cutter in the first region and the at least one cutter in the second region.

10. The rotary drag bit of claim 1, wherein the at least one cutter in the first region comprises a plurality of such cutters, the at least one cutter in the second region comprises a plurality of such cutters, and wherein an area over the bit body face comprising a boundary region between the first and second regions includes a plurality of cutters, at least one of the cutters in the boundary region exhibiting a chamfer of a width the same as those of the plurality of first region cutters and at least another one of the cutters in the boundary region exhibiting a chamfer of a width the same as those of the plurality of second region cutters.

11. The rotary drag bit of claim 1, further including a third region having located thereon cutters exhibiting cutting edge-adjacent chamfers different in width than the chamfers of the first and second region cutters.

12. The rotary drag bit of claim 1, wherein the bit body further includes a plurality of generally radially oriented blades projecting therefrom above the bit body face and extending to the gage, and wherein the at least one first region cutter and the at least one second region cutter are disposed on the blades.

13. A method of designing a rotary drag bit for drilling a subterranean formation, comprising:

selecting a bit body having a profile extending from a centerline to a gage;

selecting locations for disposition of cutters having superabrasive cutting faces on the bit body and along the profile between the centerline and the gage;

selecting at least two different chamfer widths for cutting faces of cutters to be disposed on the bit body depending at least in part on relative predicted difficulty of cutting rock engaged by cutters at different locations along the profile.

14. The method of claim 13, further comprising selecting the at least two different chamfer widths depending in part on dynamic loading predicted to be experienced by cutters at different profile locations.

15. The method of claim 14, further comprising selecting the at least two different chamfer widths depending in part on cutter redundancy at different profile locations.

16. A method of designing a rotary drag bit for drilling a subterranean formation, comprising:

selecting a bit body having a profile extending from a centerline to a gage;

selecting locations for disposition of cutters having superabrasive cutting faces on the bit body and along the profile between the centerline and the gage;

selecting at least two different chamfer widths for cutting faces of cutters to be disposed on the bit body, depending at least in part on dynamic loading predicted to be experienced by cutters at different profile locations.

* * * * *

UNITED STATES PATENT AND TRADEMARK OFFICE
CERTIFICATE OF CORRECTION

PATENT NO : 5,960,896
DATED : October 5, 1999
INVENTOR(S) : Barr et al.

It is certified that error appears in the above-identified patent and that said Letters Patent are hereby corrected as shown below:

Column 3, line 9, after "rock" delete ",";
Column 3, line 48, after "noted" insert --,--;
Column 3, line 49, after "cutters" insert --,-- and after "sizes" insert --,--;
Column 3, line 52, after "PDC" insert --diamond--;
Column 4, line 1, after "of" at end of line insert --diamond--;
Column 4, line 13, after "PDC" insert --diamond--;
Column 4, line 30, after "of" insert --diamond--;
Column 4, line 47, after "wherein" insert --diamond--;
Column 4, line 53, after "and" insert --diamond--;
Column 5, line 2, after "a" (both occurrences) insert --bit--;
Column 5, line 27, delete "formation 46" and insert --formation 40--;
Column 5, line 33, after "area 227" insert --(which may be referred to as a third region on profile 224)--; and
Column 5, line 65, change "addition" to --additions--.

Signed and Sealed this

Tenth Day of April, 2001

*Attest:*

Nicholas P. Godici

NICHOLAS P. GODICI

*Attesting Officer*

*Acting Director of the United States Patent and Trademark Office*